US011408211B1

(12) United States Patent
Shaffer

(10) Patent No.: US 11,408,211 B1
(45) Date of Patent: Aug. 9, 2022

(54) SAFETY GATE LATCH

(71) Applicant: Scott Shaffer, Titusville, FL (US)

(72) Inventor: Scott Shaffer, Titusville, FL (US)

( * ) Notice: Subject to any disclaimer, the term of this patent is extended or adjusted under 35 U.S.C. 154(b) by 532 days.

(21) Appl. No.: 15/966,478

(22) Filed: Apr. 30, 2018

Related U.S. Application Data

(60) Continuation-in-part of application No. 14/664,334, filed on Mar. 20, 2015, now Pat. No. 9,957,739, which is a division of application No. 13/456,665, filed on Apr. 26, 2012, now Pat. No. 9,010,816.

(51) Int. Cl.

| | |
|---|---|
| ***E05B 65/00*** | (2006.01) |
| ***E05C 3/12*** | (2006.01) |
| ***E05C 19/00*** | (2006.01) |
| *E05B 17/00* | (2006.01) |
| *E05B 15/16* | (2006.01) |

(52) U.S. Cl.
CPC ..... *E05C 3/12* (2013.01); *E05B 65/0007* (2013.01); *E05C 3/122* (2013.01); *E05C 19/007* (2013.01); *E05B 15/1607* (2013.01); *E05B 17/0045* (2013.01); *Y10S 292/56* (2013.01); *Y10S 292/73* (2013.01); *Y10T 292/1043* (2015.04); *Y10T 292/1044* (2015.04); *Y10T 292/14* (2015.04)

(58) Field of Classification Search
CPC ..... E05B 17/0045; E05B 65/0007; E05B 13/001; E05B 1/0061; Y10S 292/56; Y10T 292/02; Y10T 292/03
See application file for complete search history.

(56) References Cited

U.S. PATENT DOCUMENTS

| | | | | |
|---|---|---|---|---|
| 497,395 | A | 5/1893 | Whitter | |
| 574,755 | A * | 1/1897 | Oehler | A47J 45/074 16/433 |
| 1,193,386 | A | 8/1916 | Hill | |
| 1,258,624 | A * | 3/1918 | Swank | E05B 65/0007 292/3 |
| 1,280,665 | A | 10/1918 | Clay | |
| 1,438,883 | A * | 12/1922 | Youngren | A61H 3/0277 292/338 |
| 1,471,206 | A | 10/1923 | Reynolds | |
| 1,556,966 | A * | 10/1925 | Selig | G05G 1/12 16/441 |
| 1,609,117 | A * | 11/1926 | Hansen | G05G 1/085 16/421 |
| 1,664,174 | A | 3/1928 | Hoopes, Jr. | |
| 1,841,890 | A | 1/1932 | Hannon | |
| 2,142,425 | A * | 1/1939 | Tringale | E05B 77/38 292/2 |
| 2,203,333 | A | 6/1940 | Klumpp | |
| 2,277,168 | A | 3/1942 | Strom | |

(Continued)

*Primary Examiner* — Carlos Lugo
(74) *Attorney, Agent, or Firm* — Brian S. Steinberger; Hilary F. Steinberger; Law Offices of Brian S. Steinberger, P.A.

(57) ABSTRACT

Two part sleeves that fasten about existing arms of U-shaped gate latches, and bonded or slide on sleeve and cover devices, and replacement gate latches and methods for preventing injury with oar, fork and U-shaped gate latches that are pivotally attached to fixed support post next to an opening in a fence. The sleeves and covers and replacement oar, fork and U-shaped gate latches have enlarged blunt tips that can include bulbous, dome and ball shapes that prevent injury from children or adults that come into contact with the gate latches.

17 Claims, 14 Drawing Sheets

(56) References Cited

U.S. PATENT DOCUMENTS

| | | | | |
|---|---|---|---|---|
| 2,666,660 | A | 1/1954 | Voungworth | |
| 2,887,548 | A | 8/1954 | Price | |
| 2,869,913 | A * | 1/1959 | Schlage | E05B 17/0045 292/341.12 |
| 2,997,089 | A * | 8/1961 | Amdur | E05B 1/0061 16/402 |
| 2,999,523 | A * | 9/1961 | Amdur | E05B 1/0061 16/402 |
| 3,141,188 | A | 7/1964 | Gray | |
| 3,742,204 | A * | 6/1973 | Price | B60Q 3/283 362/491 |
| 4,111,475 | A | 9/1978 | McCormick et al. | |
| 4,193,232 | A | 3/1980 | Almsted et al. | |
| 4,233,780 | A | 11/1980 | Royce et al. | |
| 4,595,230 | A | 6/1986 | Fettes | |
| 4,691,541 | A | 9/1987 | McQuade, Sr. | |
| 4,784,386 | A | 11/1988 | Muehl | |
| 4,919,463 | A | 4/1990 | McQuade | |
| 5,016,928 | A | 5/1991 | Segovia | |
| 5,423,583 | A * | 6/1995 | Crockom | E05B 17/142 292/1 |
| 2,721,597 | A | 10/1995 | Pitrella | |
| 5,501,494 | A | 3/1996 | Willetts | |
| 5,593,141 | A | 1/1997 | Cain et al. | |
| 5,794,871 | A | 8/1998 | Willetts | |
| 5,882,667 | A | 3/1999 | Jones | |
| 6,185,786 | B1 * | 2/2001 | Garcia | G05G 1/10 16/421 |
| 7,360,804 | B1 | 4/2008 | Fidali et al. | |
| 7,661,734 | B2 | 2/2010 | Lignell | |
| 7,743,780 | B1 | 6/2010 | Eggan | |
| 7,882,848 | B2 | 2/2011 | Diamond | |
| 7,905,525 | B2 | 3/2011 | Badia | |
| 8,230,552 | B2 | 7/2012 | Klugh et al. | |
| 8,491,020 | B2 | 7/2013 | Lopes | |
| 9,010,816 | B1 * | 4/2015 | Shaffer | E05C 19/007 292/252 |
| 9,957,739 | B1 | 5/2018 | Shaffer | |
| 2005/0034270 | A1 | 2/2005 | Newman et al. | |
| 2006/0006678 | A1 | 1/2006 | Herron, Jr. | |
| 2007/0102080 | A1 | 5/2007 | Spangler | |
| 2011/0084185 | A1 | 4/2011 | Frankel | |
| 2012/0060877 | A1 | 5/2012 | Kirby | |
| 2012/0146344 | A1 | 6/2012 | Markou | |

* cited by examiner

FIG. 7
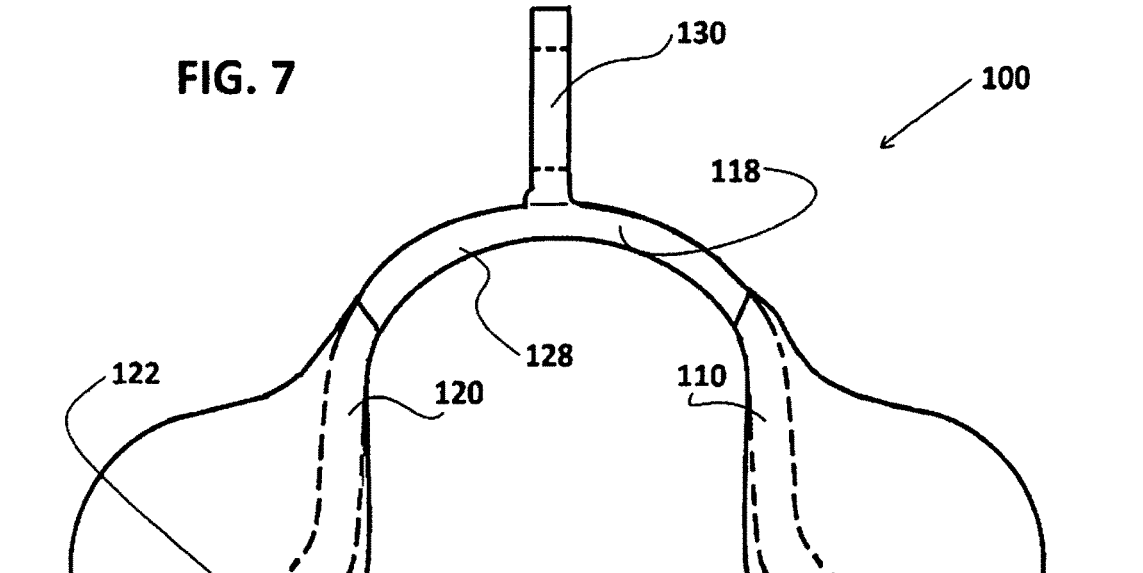
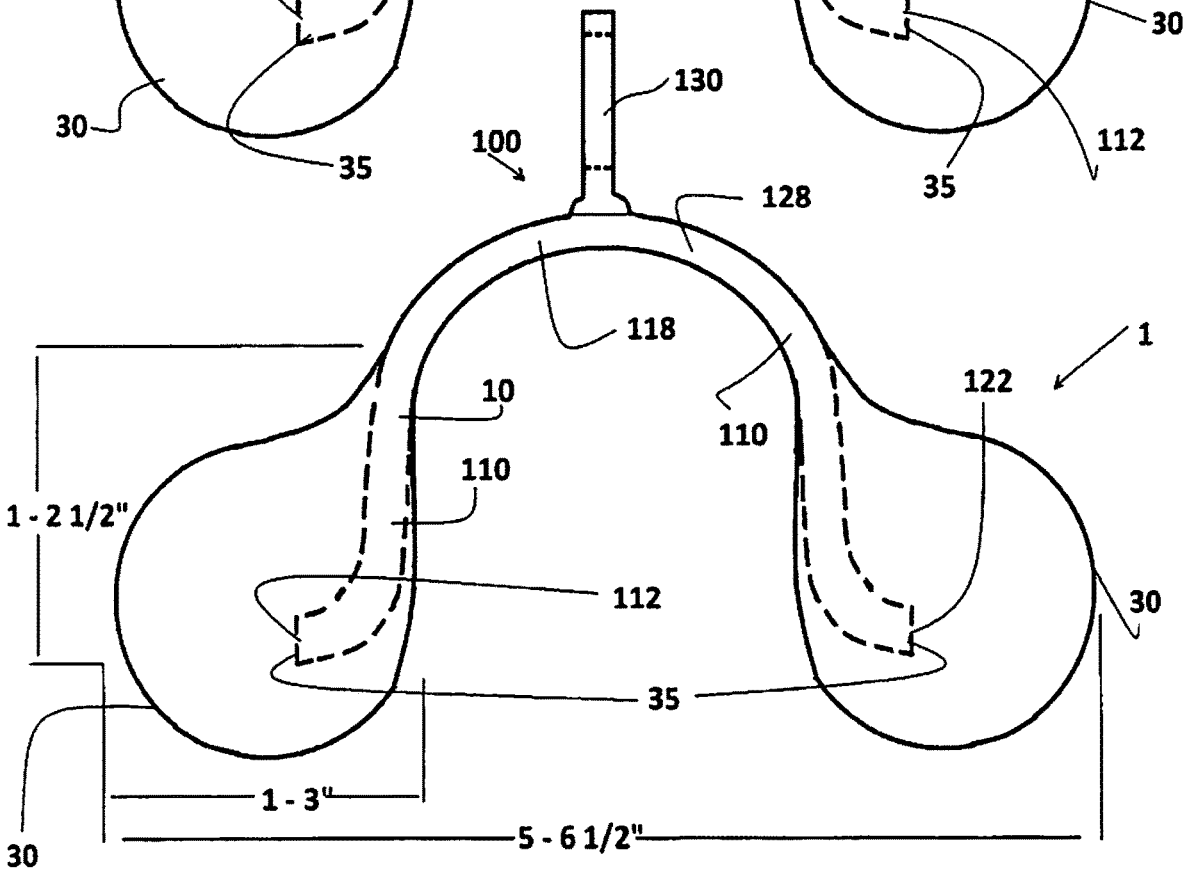
FIG. 8

FIG. 14
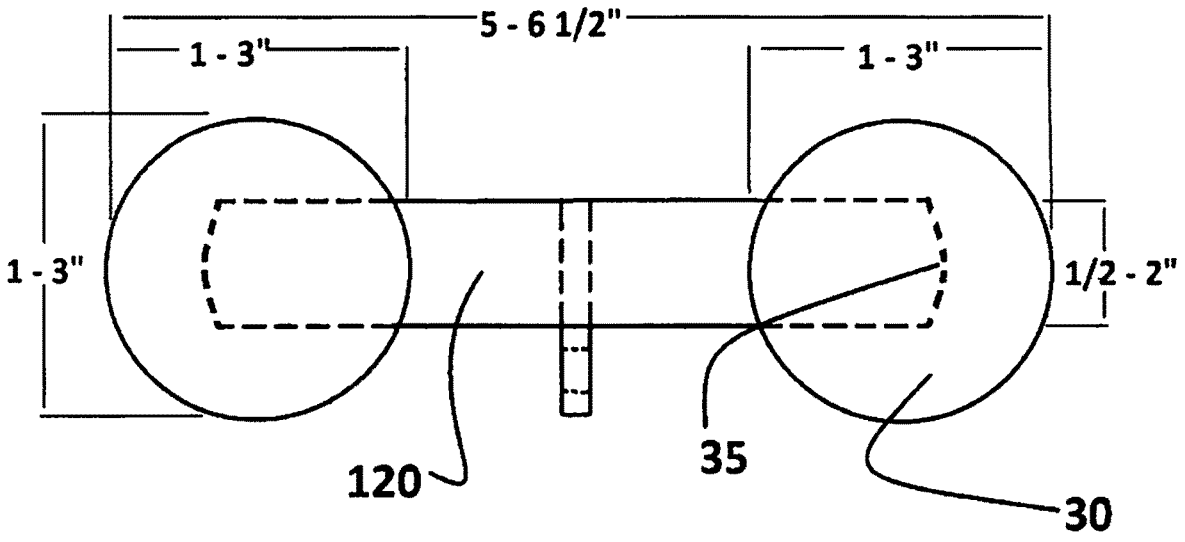
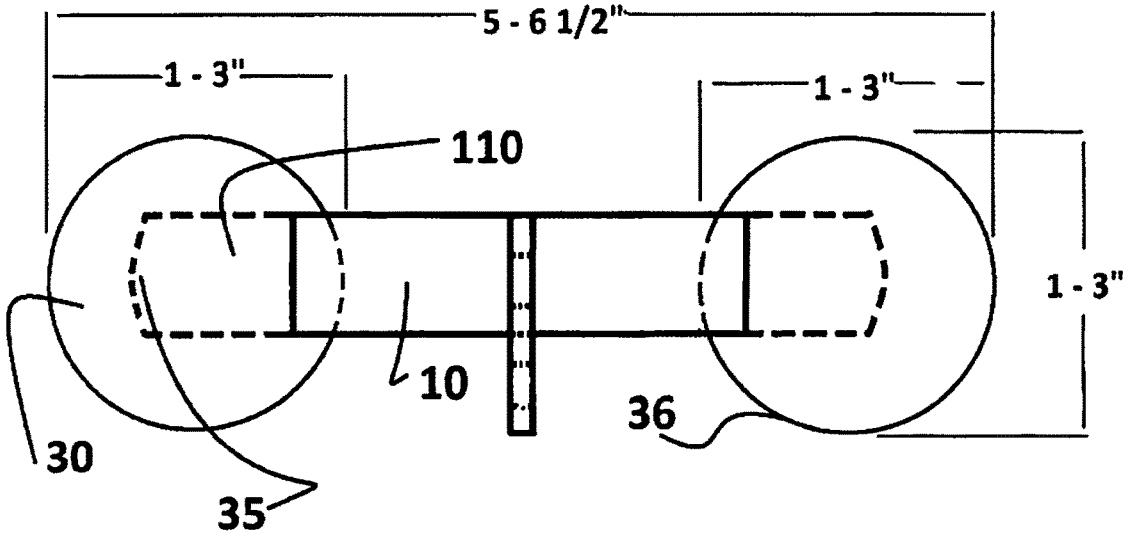
FIG. 15

SAFETY GATE LATCH

This application is a Continuation-In-Part of U.S. patent application Ser. No. 14/664,334 filed Mar. 20, 2015, now U.S. Pat. No. 9,957,739, which is a Divisional of U.S. patent application Ser. No. 13/456,665 filed Apr. 26, 2012, now U.S. Pat. No. 9,010,816. The entire disclosure of each of the applications listed in this paragraph are incorporated herein by specific reference thereto.

FIELD OF INVENTION

This invention relates to oar, fork and U-shaped gate latches, and in particular to two part sleeves that fasten about existing arms of U-shaped gate latches, as well as bonded and slide on sleeve and cover devices, and replacement gate latches and methods for preventing injury with persons that come into contact with oar, fork and U-shape gate latches that are pivotally attached to fixed support posts next to an opening in a fence.

BACKGROUND AND PRIOR ART

Popular gate latches for mesh fences will often use a pivotable oar, fork or U-shaped latches to lock and unlock a swinging gate which is used to open and close an opening in a mesh fence. One side of the gate is usually hingedly attached to a fixed support post. The free swinging edge post of the gate will swing into and out of the pivotable gate latch. See for example, U.S. Pat. No. 2,666,660 to Yougworth; U.S. Pat. No. 4,691,541 to McQuade Sr.; and U.S. Pat. No. 5,593,141 to Cain et al. A problem with these popular gate latches are their narrow and often sharp metal tips which become protruding hazards when the gates are left open.

When the gate is open, the metal tips of the oar, fork or U-shape latch is generally facing sideways in a horizontal direction where the prong arms of the latch are parallel to the ground. Even if the outer tips are rounded, in these horizontal positions, injury can easily occur to someone walking into the gate latch. The problem is further compounded on playgrounds and school yards where running children can go front first and/or back first into these protruding hazards causing skin lacerations and punctures. Small children also have the danger of these protruding hazards being at face and eye level that can further cause serious harm.

Various attempts have been tried over the years to fix the problem. For example, wrapping electrical type tape around the latches is only a temporary fix, since the tape would unwrap over time, and the tape would be an attractive nuisance for children who would want to pull the tape loose. Sticking an old tennis ball on the latch is also only a temporary fix, since the ball would easily fall off or be easily pulled off.

The inventor is not aware of any products and solutions to protect children and/or adults from being injured by the protruding hazards of these oar, fork and U-shape gate latches that are left in their horizontal and unlocked positions. Thus, the need exists for solutions to the above problems with the prior art.

SUMMARY OF THE INVENTION

A primary objective of the present invention is to provide bonded on sleeve and cover devices, and methods for preventing injury from using oar, fork and U-shape gate latches that are pivotally attached to fixed support post next to an opening in a fence.

A secondary objective of the present invention is to provide slide on sleeve and cover devices, and methods for preventing injury from using oar, fork and U-shape gate latches that are pivotally attached to fixed support post next to an opening in a fence.

A third objective of the present invention is to provide replacement gate latches and methods for preventing injury from using oar, fork and U-shape gate latches that are pivotally attached to fixed support post next to an opening in a fence.

An embodiment of a the sleeve covers for a pivotable oar, fork and U shaped gate latch, can include a first sleeve having a closed end and an open end, the closed end having a rounded blunt exterior surface and a diameter substantially larger in diameter than a diameter of the open end of the sleeve, and a second sleeve having a closed end and an open end, the closed end having a rounded blunt exterior surface and a diameter substantially larger in diameter than a diameter of the open end of the sleeve, wherein the first sleeve and the second sleeve are adapted to slide on and cover the exposed existing tip ends of existing arms on a pivotable gate latch.

The closed end of each of the first sleeve and the second sleeve can each include generally bulbous shape.

The closed end of each of the first sleeve and the second sleeve can each include a generally ball shape.

The closed end of each of the first sleeve and the second sleeve can each include a generally dome shape.

The diameter of the closed end can be at least twice the diameter of the exposed tip ends of the arms on the oar, fork and U shaped gate latch.

The first sleeve and the second sleeve can attach to the gate latch by sliding over the existing arms of the oar, fork and U shaped gate latch.

The first sleeve and the second sleeve can attach to the gate latch by being bonded to the existing arms of the oar, fork and U shaped gate latch.

The first and the second sleeve covers can be formed from a rubber material.

The first and the second sleeve covers can be formed from a plastic material.

A replacement pivotable oar, fork and U shaped gate latch can include a first curved arm with an exposed outer end and a rear end, the outer end having a diameter substantially larger than a diameter of the rear end, the outer end having a rounded edge, a second curved arm with an exposed outer end and a rear end, the outer end having a diameter substantially larger than a diameter of the rear end, the outer end having a rounded edge, and a pivotable mid portion attached to the rear end of the first curved arm and the rear end of the second curved arm for allowing the first arm and second arm to pivot together in a U-shaped configuration about a gate edge.

The exposed outer end of the first arm and the second arm each can include a generally bulbous shape.

The exposed outer end of the first arm and the second arm can each include a generally ball shape.

The exposed outer end of the first arm and the second arm can each include a generally dome shape.

The diameter of the exposed outer end of the first arm and the second arm can be at least twice the diameter as the rear end of the first arm and the second arm.

Another embodiment can use ball covers for protecting exposed parts of a pivotable oar, fork and U shaped gate latch that includes a first ball with a rubber spherical outer core, the first ball having a slit opening along one side portion, a second ball with a rubber spherical outer core, the second ball having a slit opening along one side portion, and a caulking material to be injected into each of the first ball and the second ball, wherein the slits of the first and second balls are adapted to slide over exposed tip ends of existing arms on a pivotable gate latch so that the balls provide protection to the exposed tip ends of the existing arms on the pivotable gate latch.

The balls used can be tennis balls, and the caulking material can be silicon.

The arms of the replacement latch can be formed from metal. The arms can be formed from nonmetal materials or combinations of metal and nonmetal. The arms can be formed from rubber. The arms can be formed from plastic.

Further objects and advantages of this invention will be apparent from the following detailed description of the presently preferred embodiments which are illustrated schematically in the accompanying drawings.

BRIEF DESCRIPTION OF THE FIGURES

FIG. 7 is a top view of the sleeve covers attached to the gate latch of FIG. 5.

FIG. 8 is a bottom view of the sleeve covers attached to the gate latch of FIG. 5.

FIG. 14 is a right end view of the embodiment of FIG. 13.

FIG. 15 is a left end view of the embodiment of FIG. 13.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

A listing of components will now be described.

Figure 1:
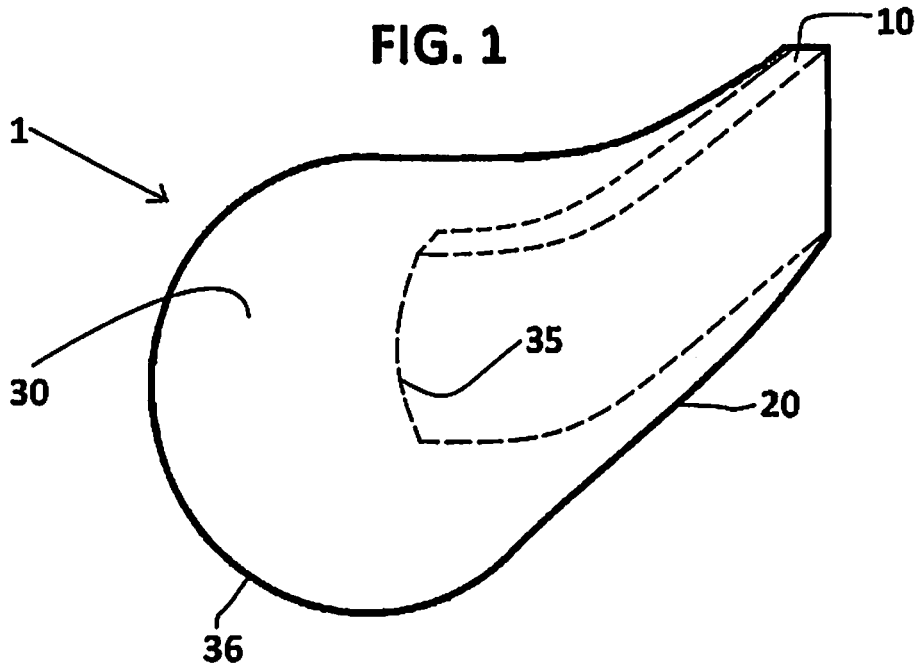
FIG. 1 is a front right perspective view of the sleeve cover invention.
Figure 2:
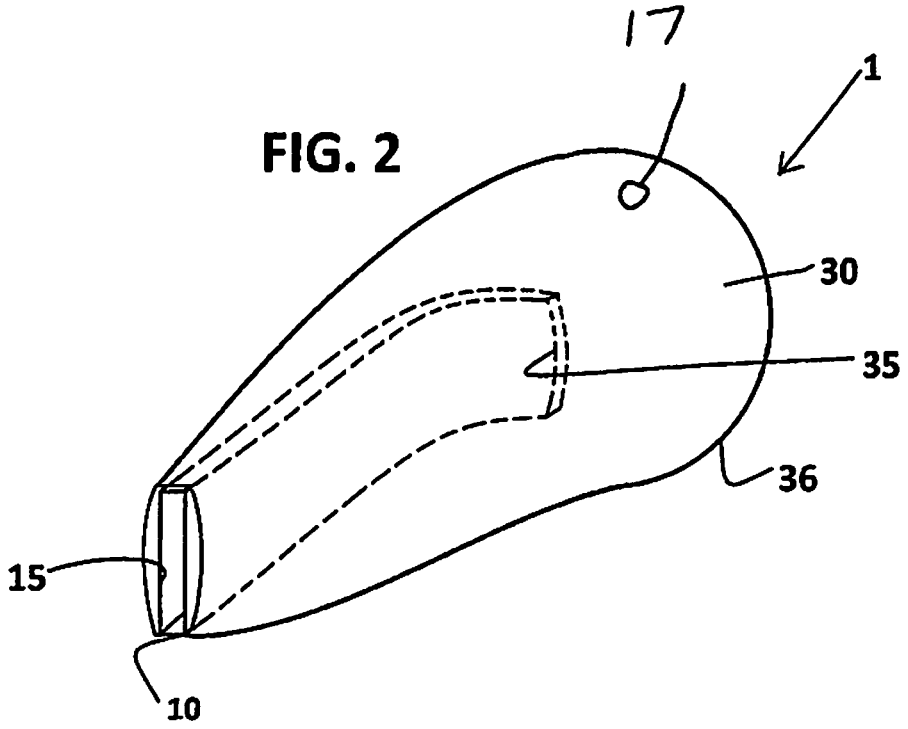
FIG. 2 is a rear right perspective view of the sleeve cover of FIG. 1.
Figure 3:
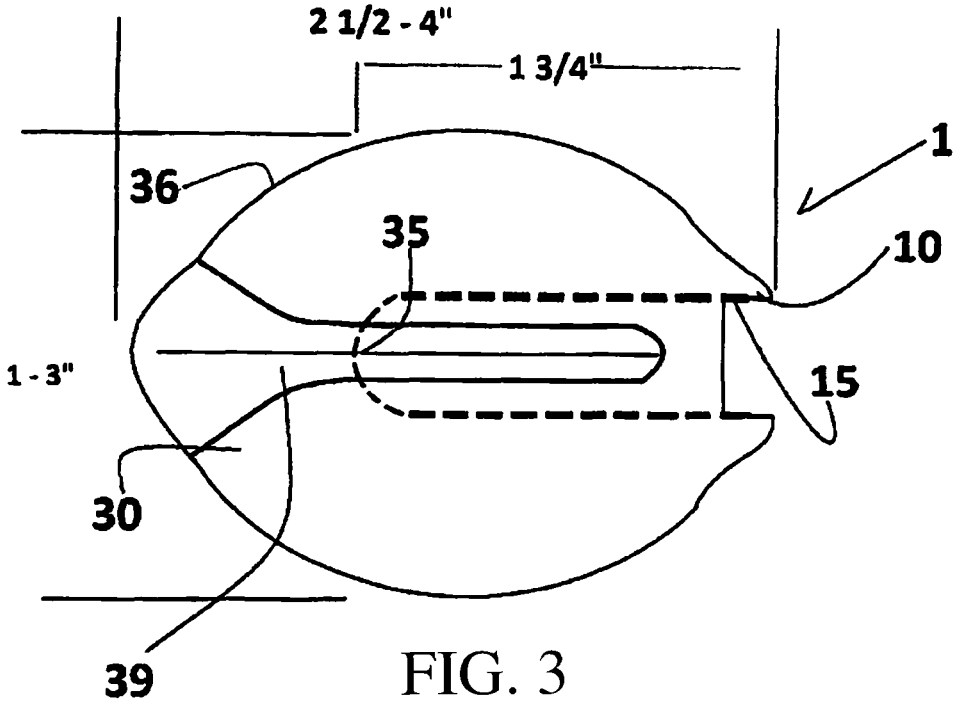
FIG. 3 is right side view of the cover of FIG. 1.
Figure 4:
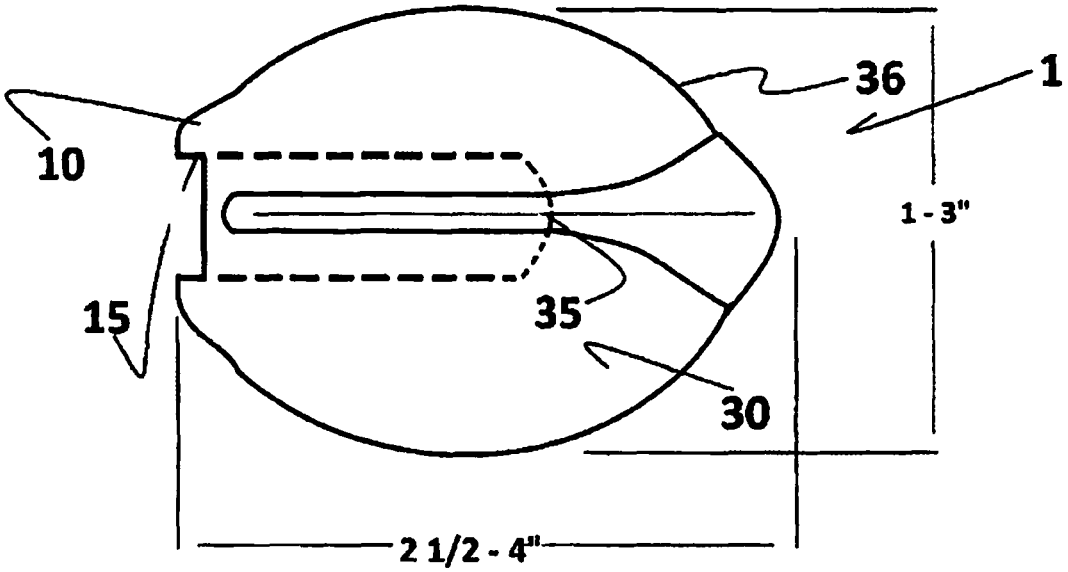
FIG. 4 is a left side view of the cover of FIG. 1.

1. sleeve cover for oar, fork or U-shape gate latch
10. root end
15. opening in root end for flange arm of gate latch
17 fill port
20. mid body
30. head end
35. stop inside of head for tip of flange arm of gate latch
36. rounded dome, bulbous or spherical exterior surface
39. side support brace with angled tip
100. existing oar, fork or U-shape gate latch
110. left curved flange arm
112. tip end of left flange arm
115 grooves and/or openings
118. bracket end of left flange arm
120. right curved flange arm
122. tip end of right flange arm
125 grooves and/or openings
128. bracket end of right flange arm
130. bracket for pivotally attaching gate latch to fence post
200. replacement oar, fork or U-shape gate latch
300. ball
350. slit
375. fill port
400 two part sleeve embodiment
410 first half sleeve
412 stem end of first half sleeve
413 one indent for screw fastener
414 enlarged rounded midportion
415 elongated curved channel
416 concave tip end
417 second indent for screw fastener
419 concave insert opening
420 second half sleeve
422 stem end of first half sleeve
423 one threaded shaft for screw fastener
424 enlarged rounded midportion
425 elongated curved channel
426 concave tip end
427 second threaded shaft for screw fastener
429 concave insert opening
432 first fastener, such as a screw, self tapping fastener, friction fit pin
434 second fastener, such as screw, self tapping fastener, friction fit pin
440 rubber insert bumper
442 rounded cap head
444 stem with outer expanding sides FIG. 1 is a front right perspective view of the sleeve cover invention 1. FIG. 2 is a rear right perspective view of the sleeve cover 1 of FIG. 1. FIG. 3 is right side view of the cover 1 of FIG. 1. FIG. 4 is a left side view of the cover 1 of FIG. 1.

Referring to FIGS. 1-4, the sleeve cover 1 can be used as a protective cover for the exposed arms of an oar, fork or U-shape gate latch which are referenced in the background of this invention. The sleeve cover can include a root end 10 having an opening therein. Although the opening is shown as rectangular, the shape of the opening can be configured to the exterior geometry of the existing flange arms of an oar, fork or U-shape gate latch. The cover 1 can have a generally elongated shape with a mid body portion 20 and head portion 30. The head portion 30 can have bulbous, or ball or dome shaped configuration with an outer rounded surface 36. Inside the head portion can be an end or stop 35 against which the tip end of the flange arm(s) of the oar, fork or U-shape gate latch rests. The cover 1 is shown having the head 30 bent to one side to follow the contours of the underlying flange arms of the oar, fork or U-shape gate latch. If the flange arms are straight the head portion 30 may not need to be bent to one side.

Referring to FIGS. 3-4, an optional side support brace with angled tip 39 can be used to add additional rigidity to the cover 1.

A preferred embodiment of the cover 1 can have dimensions of approximately 1 ½ inches to approximately 4 inches long between the root end 10 and outer surface edge of the head 30. The diameter of the opening 15 can be between approximately ½ inch to approximately 1½ inches in diameter that would depend on the width of the arm flanges of the existing oar, fork or U-shape gate latch. The head 30 can have a diameter of approximately 1½ inches to approximately 3 inches.

Figure 5:
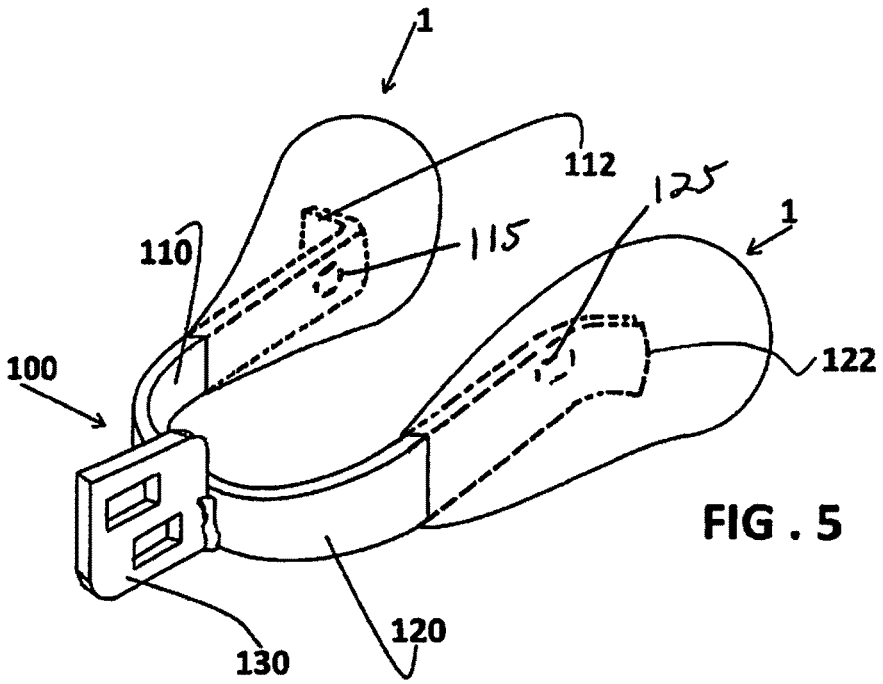
FIG. 5 is a rear top perspective view of the sleeve covers of FIG. 1 attached to an oar, fork or U-shape gate latch.
Figure 6:
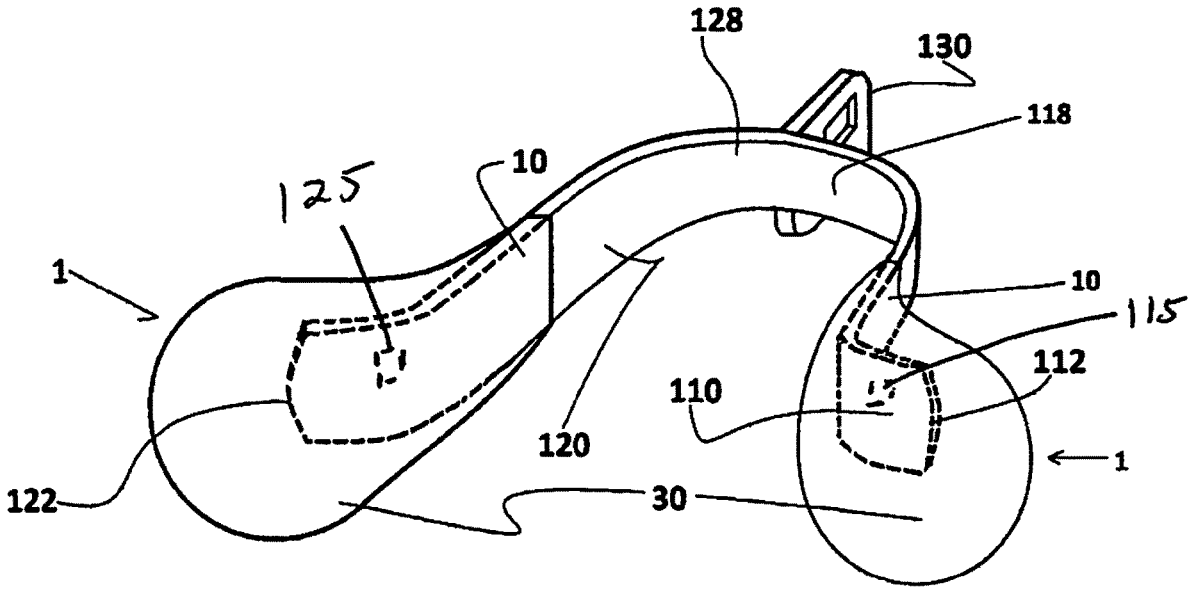
FIG. 6 is a front top perspective view of the sleeve covers attached to the oar, fork or U-shape gate latch of FIG. 5.

FIG. 5 is a rear top perspective view of the sleeve covers 1 of FIG. 1 attached to an oar, fork or U-shape gate latch 100. FIG. 6 is a front top perspective view of the sleeve covers 1 attached to the oar, fork or U-shape gate latch 100 of FIG. 5. FIG. 7 is a top view of the sleeve covers 1 attached to the gate latch 100 of FIG. 5. FIG. 8 is a bottom view of the sleeve covers 1 attached to the gate latch 100 of FIG. 5.

Referring to FIGS. 1-8, each of the sleeve covers 1 can be either slid over or bonded to the flange arms 110, 120 of the oar, fork or U-shape bracket 100. The flange arms 110, 120 with tip end 112, 122, rear end 118, 128 and bracket 130 can be an existing oar, fork or U-shape bracket, such as those shown and described in the background of the invention. Such types of oar, fork or U-shape bracket 100 include but are not limited to U.S. Pat. No. 2,666,660 to Yougworth; U.S. Pat. No. 4,691,541 to McQuade Sr.; and U.S. Pat. No. 5,593,141 to Cain et al., which are each incorporated by reference. The tip end 112 of one flange arm 110 can rest against an interior stop or end 35 inside the head 30 of the cover 1. The tip end 122 of another flange arm 120 can rest against an interior stop or end 35 inside the head 30 of another cover 1.

A preferred material for the sleeves 1 can include waterproof and UV stable materials, such as but not limited to rubber, polyurethane, plastic material, elastomers, silicon, other types of synthetic polymers, combinations thereof, and the like. The covers 1 can be solid poured around existing flange arms 110, 120 of an oar, fork or U-shape bracket 100. Grooves, and/or openings 115, 125, and the like, can be drilled in the existing flange arms of the gate latch prior to casting to better enhance the bond between the covers 1 and the arms 110, 120 of the existing gate latch 100. Additional materials, such as bonding agents, and the like, can also be used.

The exteriors of the sleeves can have a soft exterior layer, such as but not limited to depressible silicon, over another underlying material layer, such as but not limited to a rigid rubber or rigid plastic. The soft exterior can be desirable to absorb impact and reduce injury from someone hitting or rubbing against the sleeve covered gate latches.

The covers 1 can also be preformed or pre-molded from similar waterproof and UV stable materials, as slide on sleeves, so that existing gate latches can be retrofitted separately by installers when needed. Pre-molded slide on sleeve covers 1 can be easily used in the field to wrap about the exposed ends of existing flange arms on oar, fork or U-shape gate latches. The slide on covers can tightly fit about the existing flange arms. Additionally, adhering agents, such as but not limited to glue and the like, can also be used to lock the covers 1 to the flange arms of the oar, fork or U-shape gate latch by being injected into a small opening port 17 similar to port 375 shown and described in relation to FIGS. 12-13. Additionally, a set screw or through-pin can be used to attach the sleeves to the latches. Still furthermore, heat such as that from the sun, or from an artificial heat source can also shrink wrap the sleeves to the latches.

Figure 9:
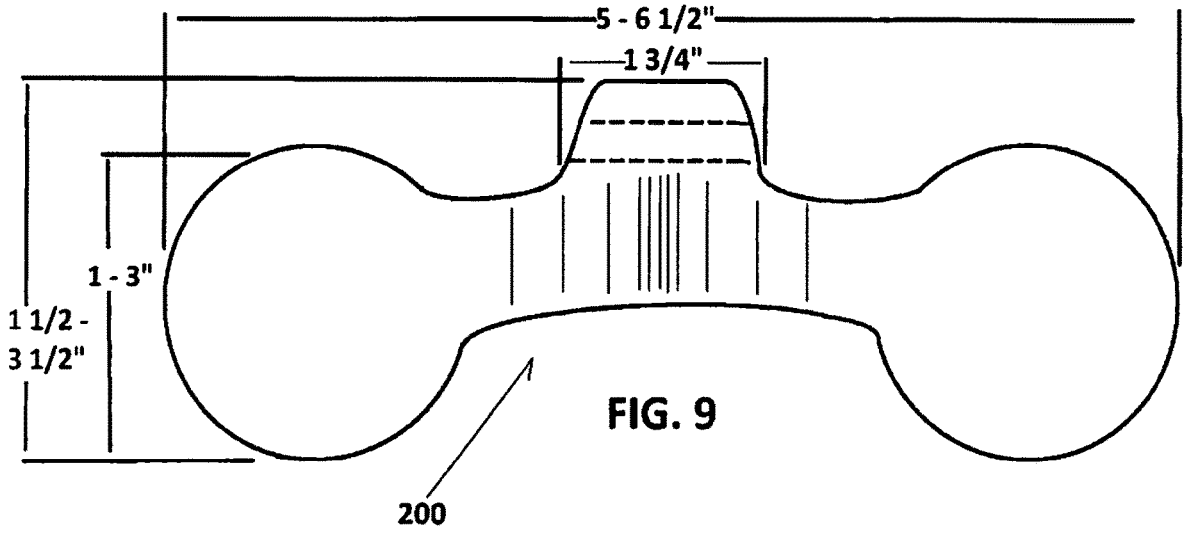
FIG. 9 is a rear view of a replacement oar, fork or U-shape gate latch.
Figure 10:
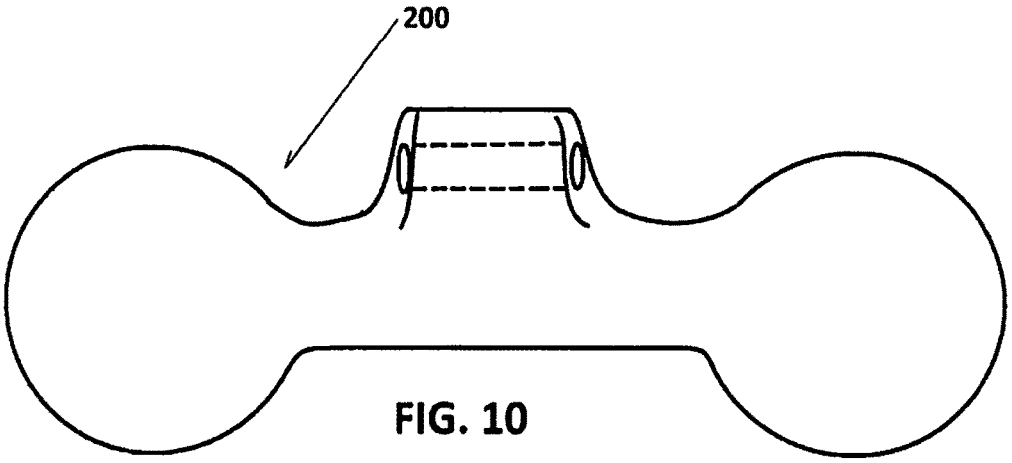
FIG. 10 is a front view of a replacement oar, fork or U-shape gate latch.
Figure 11:
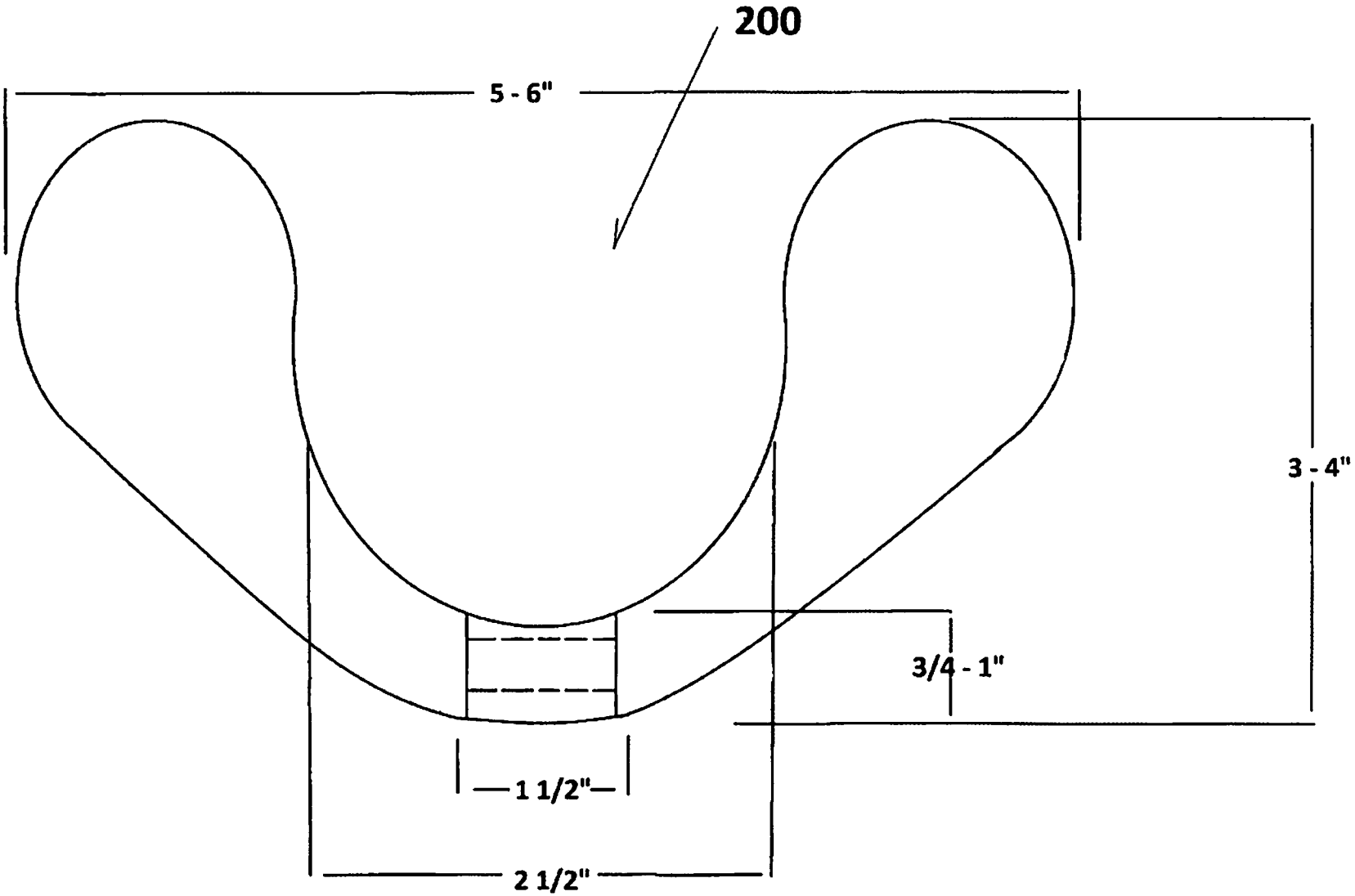
FIG. 11 is a top view of the replacement oar, fork or U-shape gate latch.

FIG. 9 is a rear view of a replacement oar, fork or U-shape gate latch 200. FIG. 10 is a front view of a replacement oar, fork or U-shape gate latch 200. In this embodiment, the entire gate latch including arms with covers and bracket can be pre-molded from non-metal flexible and semi-rigid materials, similar to the cover 1 materials. The replacement covers 200 can replace existing oar, fork or U-shape gate latches. FIG. 11 is a top view of the replacement gate latch 200 of FIGS. 9-10, and can be attached in a similar manner to the existing gate latches described in the background section of the invention.

Figure 12:
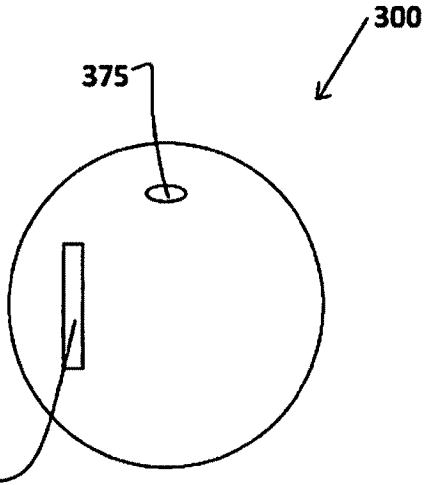
FIG. 12 shows another embodiment of using a ball with a slit in the side.
Figure 13:
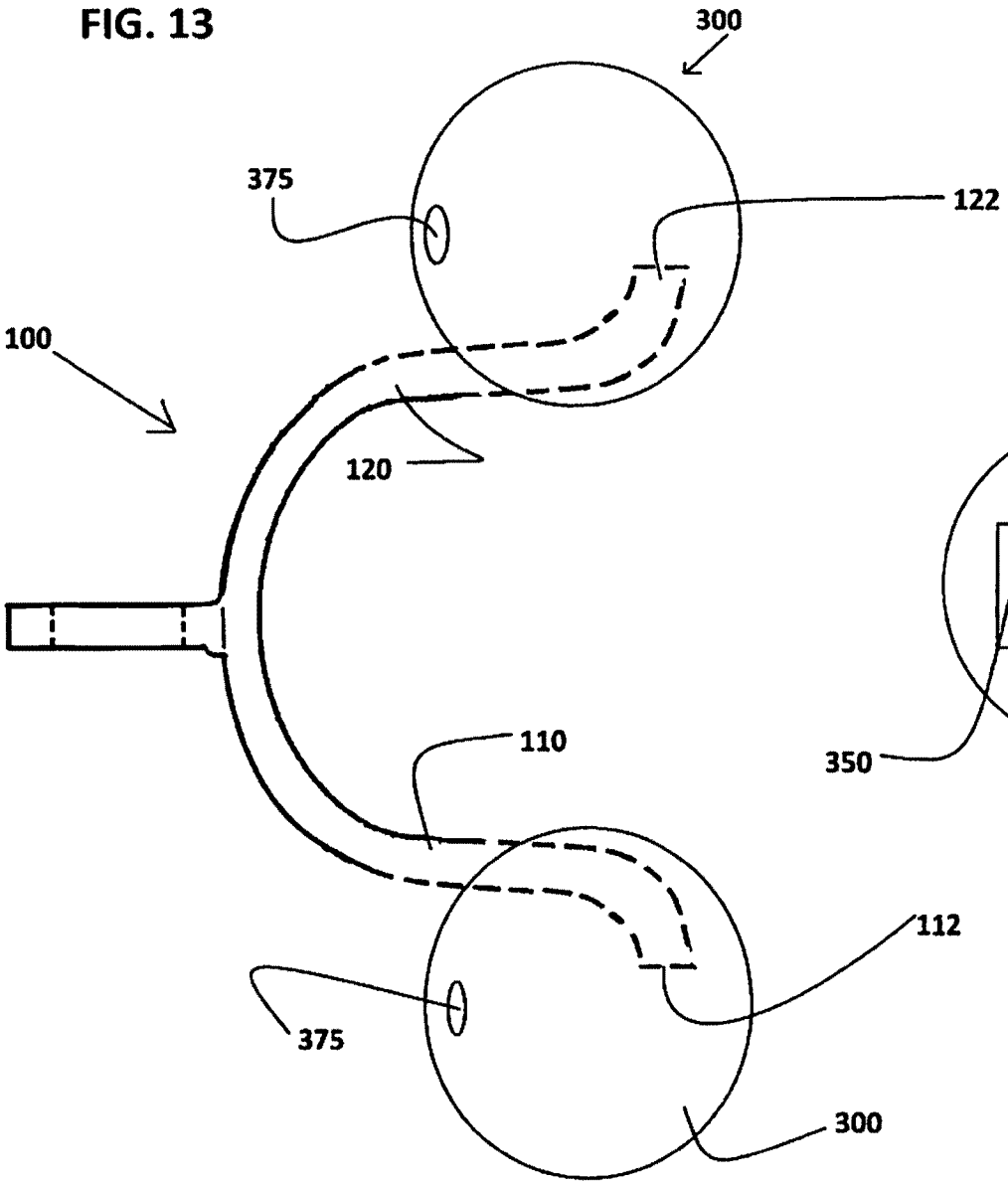
FIG. 13 shows the ball mounted to the latch where caulking material, such as but not limited to silicon is injected into the ball to fixably adhere the ball to the latch.
Figure 16:
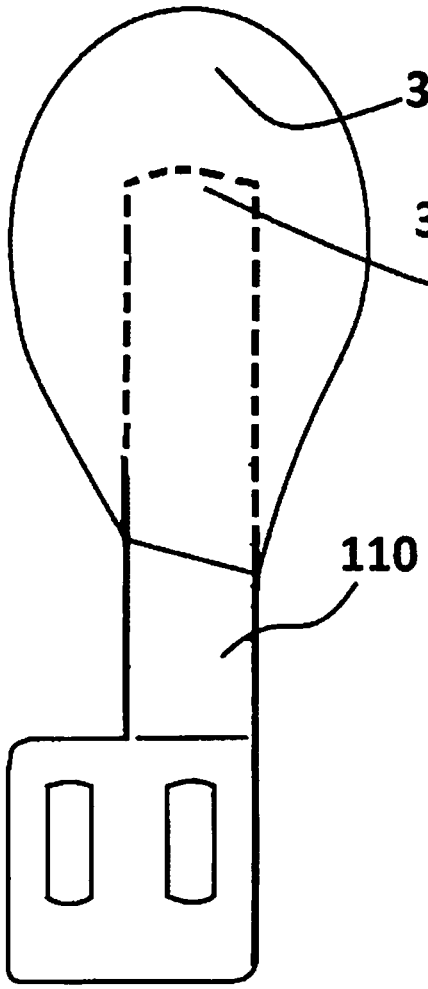
FIG. 16 is a right side view of the cover attached to the gate latch shown in FIG. 5.
Figure 17:
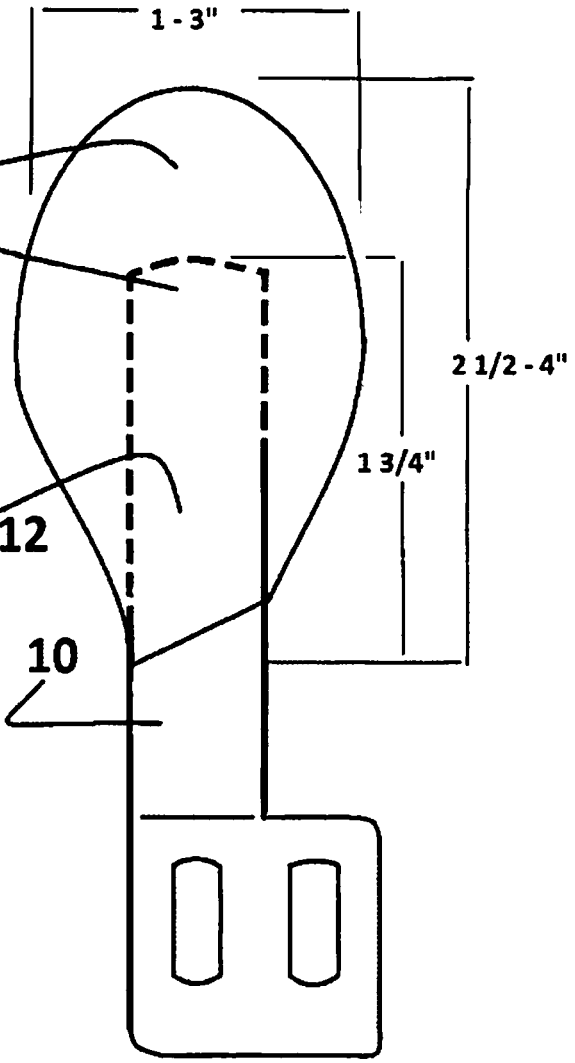
FIG. 17 is a left side view of the cover attached to the gate latch shown in FIG. 5.

FIG. 12 shows another embodiment of using a ball 300 with a slit 350 in the side. FIG. 13 shows the ball mounted to the latch where caulking material, such as but not limited to silicon is injected into the ball to fixably adhere the ball to the latch. The ball can include but not be limited to a ball having a spherical rubber type elastomer about a hollow core with an outer cloth type layer, such as a tennis ball. A typical sized tennis ball having a diameter of approximately 2.63 inches can be used.

Referring to FIGS. 12-13, a slit 350 can be cut into the side of the ball 300, and the ball placed over the tip edge of each arm flange of the gate latches 100. Next, a caulking material, such as silicon, and the like, can be injected into the slit 350 or into another opening 375, around the tip of the flange arms of the gate latches, which will fixably adhere the balls about the outer flange arm tip edges, as a safety protection.

Although tennis balls have been described, other types of hollow elastomeric spherical balls can be used, such as but not limited to a racquetball having a diameter of approximately 2.25 inches, a paddleball, other small bouncing balls, and the like. Additionally, solid balls, can be used, such as but not limited to golf balls, and the like.

The surface of the balls, bulbous portions and dome portions can have advertising indicia thereon, such as but not limited to company names, sports team names, design logos, and the like.

The pivotable oar, fork and U-shaped latches 100 shown and described in relation to the figures can pivot up or down in a vertical plane or pivot sideways in a horizontal plane to be used with existing oar, fork or U-shaped gate latches.

Although non-metal materials are described for the covers, the covers and replacement gate latches can be made from metal materials, such as but not limited to aluminum, galvanized metal, and the like, with or without non-metal materials, such as those described above.

Two Part Sleeves

Figure 18:
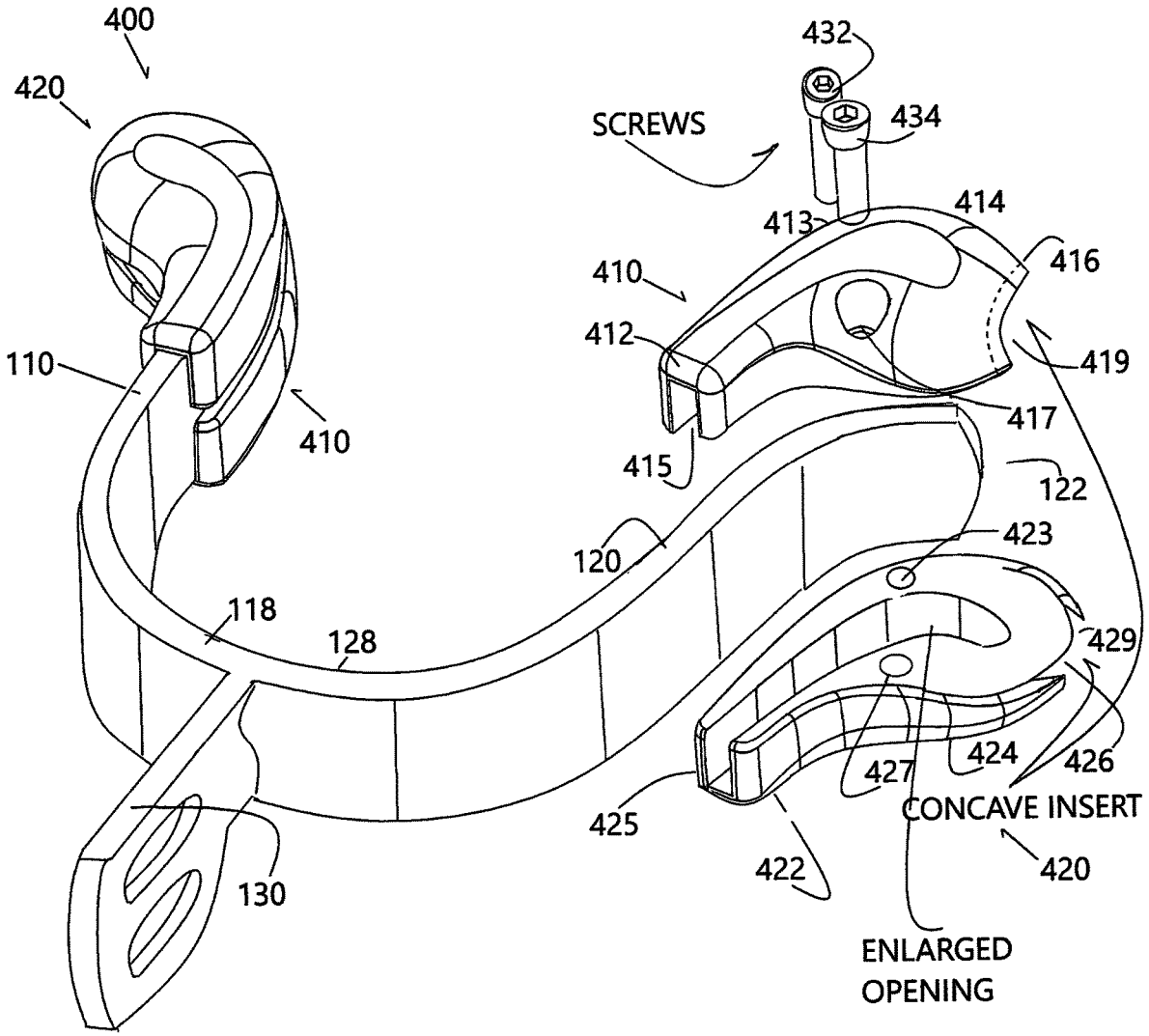
FIG. 18 is an upper perspective view of another embodiment of both an assembled two part sleeve and exploded two part sleeve with an oar, fork or U-shape gate latch.
Figure 19:
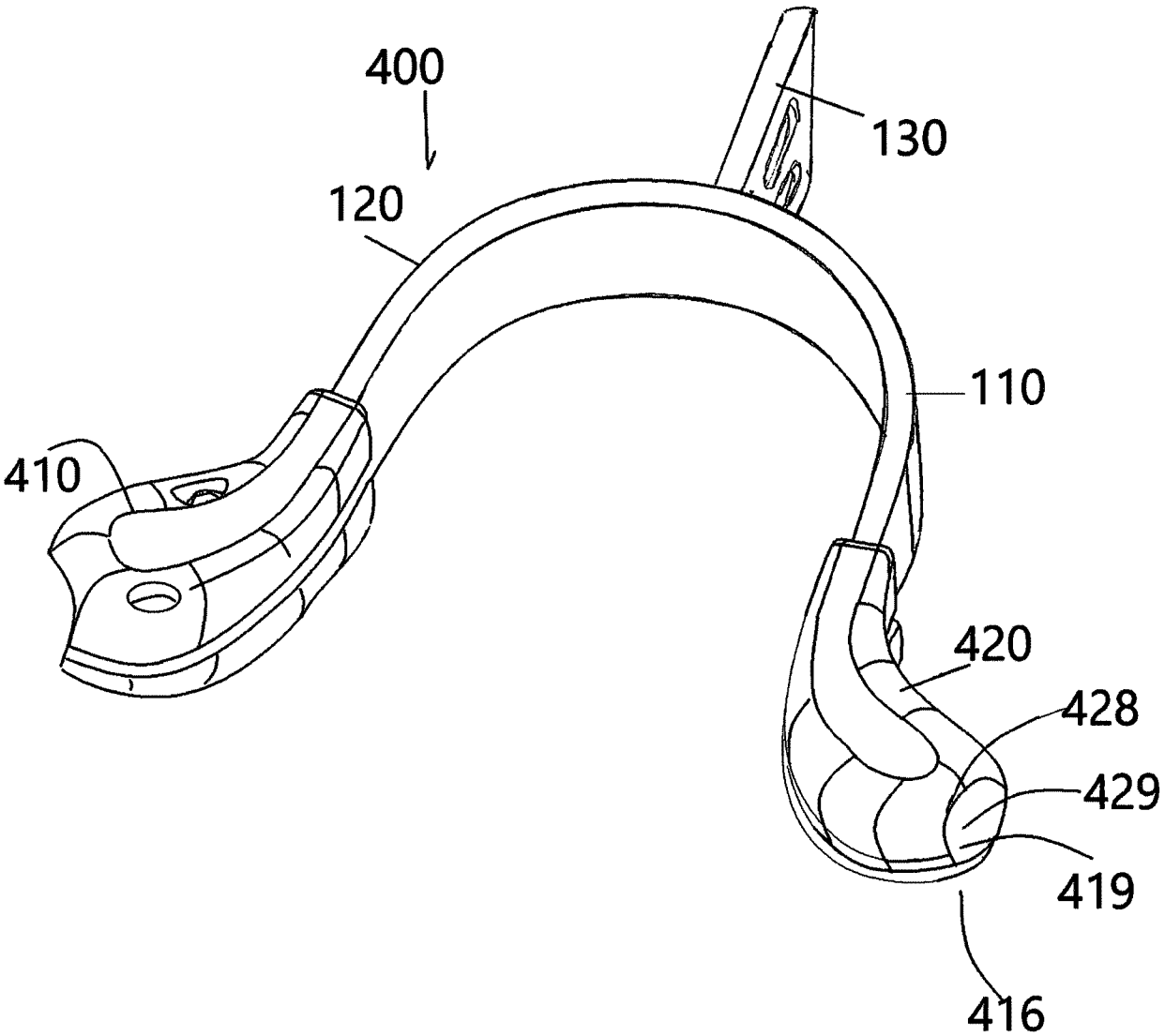
FIG. 19 is another perspective view of FIG. 18 with both two part sleeves assembled on the oar, fork or U-shape gate latch.
Figures 20, 21:
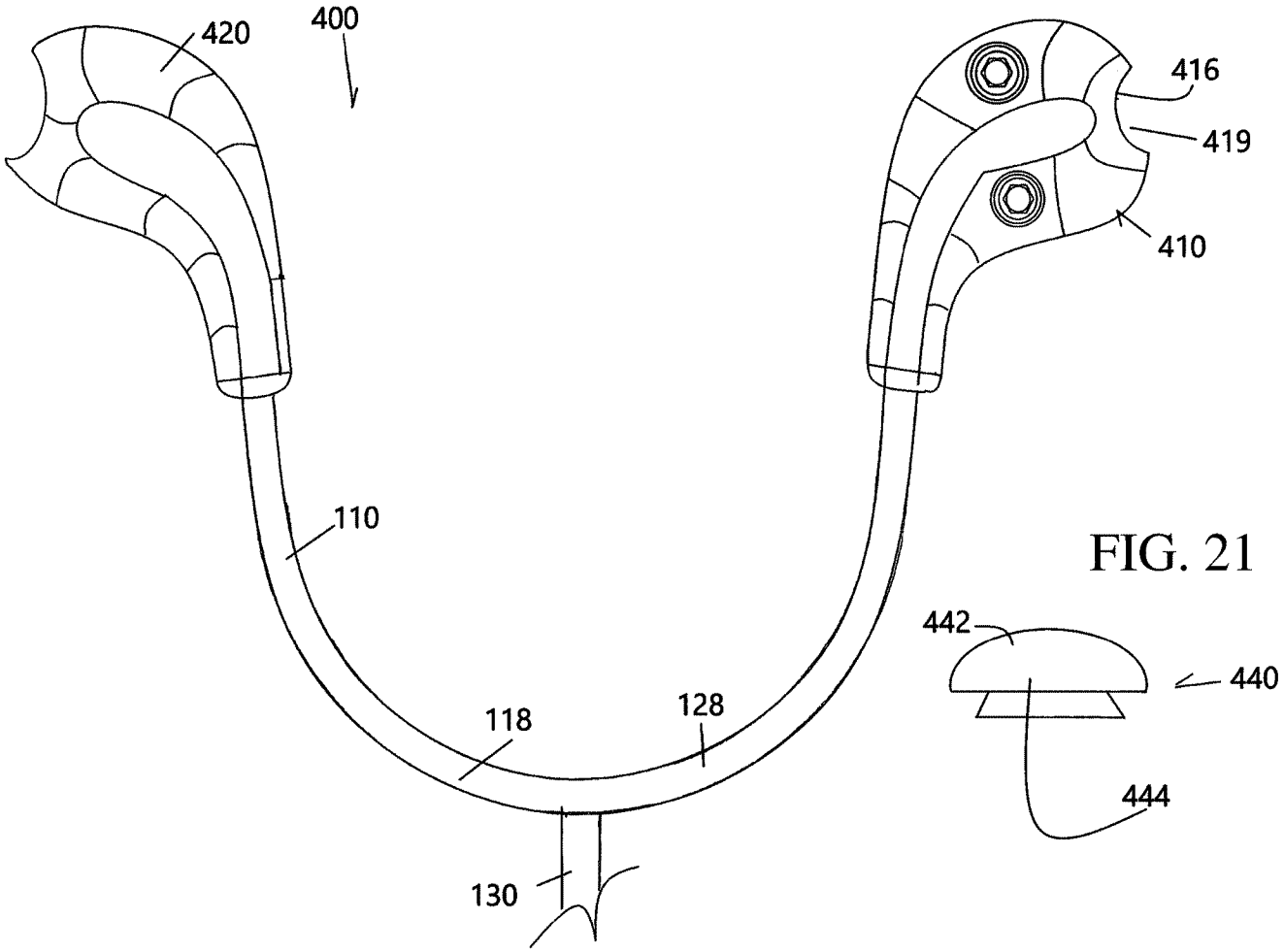
FIG. 20 is a top view of FIG. 19 showing the assembled sleeves on the oar, fork or U-shape gate latch.
FIG. 21 is a top view of the rubber insert bumper for use with the concave openings on the assembled sleeves on the oar, fork or U-shape gate latch, of FIG. 20.

FIG. 18 is an upper perspective view of another embodiment 400 of both an assembled two part sleeve 410/420 on a left curved flange arm 110 and exploded two part sleeves 410, 420 about a right curved flange arm 120. FIG. 19 is another perspective view of the embodiment of FIG. 18 with both two part sleeves 410, 420 assembled on both flange arms 110, 120 of the oar, fork or U-shape gate latch. FIG. 20 is a top view of FIG. 19 showing the assembled sleeves 410, 420 on the oar, fork or U-shape gate latch.

Referring to FIGS. 18-20, this embodiment 400 can include similar parts as shown and described in the previous embodiments. The two part sleeve embodiment 400 can include two pairs of sleeves 410 and 420 that can each wrap about left and right curved flange arms 110, 120 of an oar, fork or U-shape gate latch.

A right sleeve can include a first half sleeve 410 having a narrow stem portion 412, which expands outward along a convex curved sides to an enlarged rounded midportion 414, and tapers back along a convex curved sides to a tip end 416 that can have an outer convex curved edge and an internal concave insert opening 419. The first half sleeve 410 can have a generally flat bottom surface.

An elongated channel 415 can start from the stem end 412 and run in an elongated curve shape with an opposite closed end before the tip 416. On the top of the first half sleeve 410 can be a pair of enlarged indents 413, 417 having smaller diameter through holes in the bottom of the indents.

The right sleeve can include a second half sleeve 420 having a narrow stem portion 422, which expands outward along a convex curved sides to an enlarged rounded midportion 424, and tapers back along a convex curved sides to a tip end 426 that can have an outer convex curved edge and an internal concave insert opening 429. The second half sleeve 420 can have a generally flat top surface.

An elongated channel 425 can start from the stem end 422 and run in an elongated curve shape with an opposite closed end before the tip 426. On the top of the second half sleeve 420 can be a pair of threaded openings 423, 427.

The curved shaped openings 415, 425 in each of the half sleeves 410, 420, can each be larger than the width and/or height of each of the flange arms 110, 120.

To assemble the two part embodiment 400, the installer can position the first half sleeve 410 over and about the top of the right flange arm 120 so that the top edge of the right flange arm 120 fits into the elongated curved channel 415. Next, the installer can position the second half sleeve 420 over and about the bottom of the right flange arm 120 so that the bottom edge of the right flange arm 120 fits into the elongated curved channel 425. Next, the installer can pass the shaft ends of the screws 432, 434 into the indented portions 413, 417 and rotate the screws into the threaded openings 423, 427 in the second half sleeve 420 until both half sleeves 410, 420 abut one another. The indents 413, 417 allow for the heads on the fasteners 432, 434 to be below the outer surface of the half sleeve 410.

The left flange arm 110 can similarly be installed with the same half sleeves 410, 420, but reversing the location of the half sleeves, 410, 420. For the left flange arm 110, the first half sleeve 410 can be located underneath the left flange arm 110, and the second half sleeve 420 can be positioned over the top of the left flange arm 110, and the screws 432, 434 be used to similarly attach the half sleeves 410, 420 together.

To increase the locking of the half sleeves 410, 420 to the flange arms 110, 120, the installer can insert materials, such as but not limited to two part epoxy, caulk, glue, bonding agent, adhesive and/or expanding filling material into the curved channels 415, 425. These materials can be inserted into the curved channels 415, 425 before the half sleeves, 410, 420 are positioned on the flange arms 110, 120. Alternatively, these materials can be squeezed into the ends 412, 422 of the respective channels 415, 425 after the half sleeves 410, 420 are attached to the respective flange arms 110, 120.

Still furthermore, the channels 415, 425 can inwardly protruding wings, and/or inwardly protruding bumps or other inwardly protruding members to better cause a friction fit between the flange arms 110, 120 and the channels 415, 425 of the half sleeves 410, 420.

Figure 22:
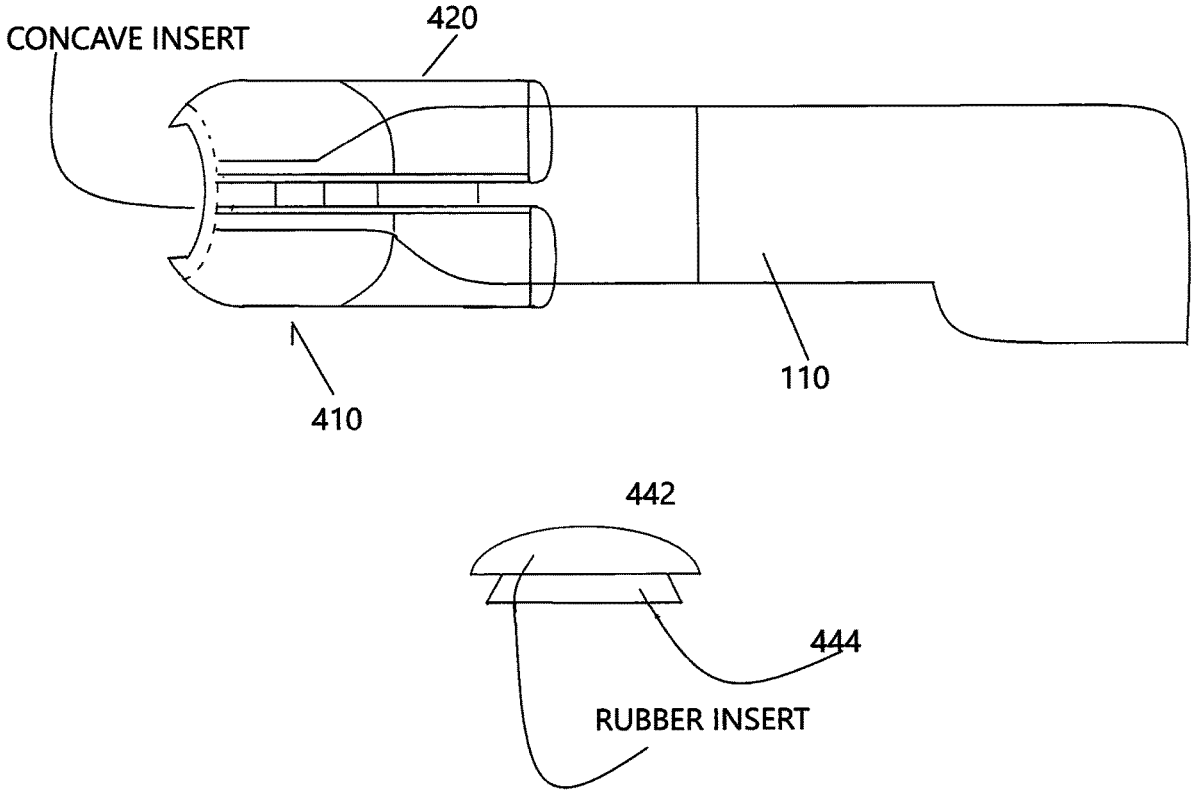
FIG. 22 is a partial rear end view of one of the assembled sleeves on one end of the oar, fork or U-shape gate latch of the preceding figures with the rubber insert bumper ready to be attached thereon.
Figure 23:
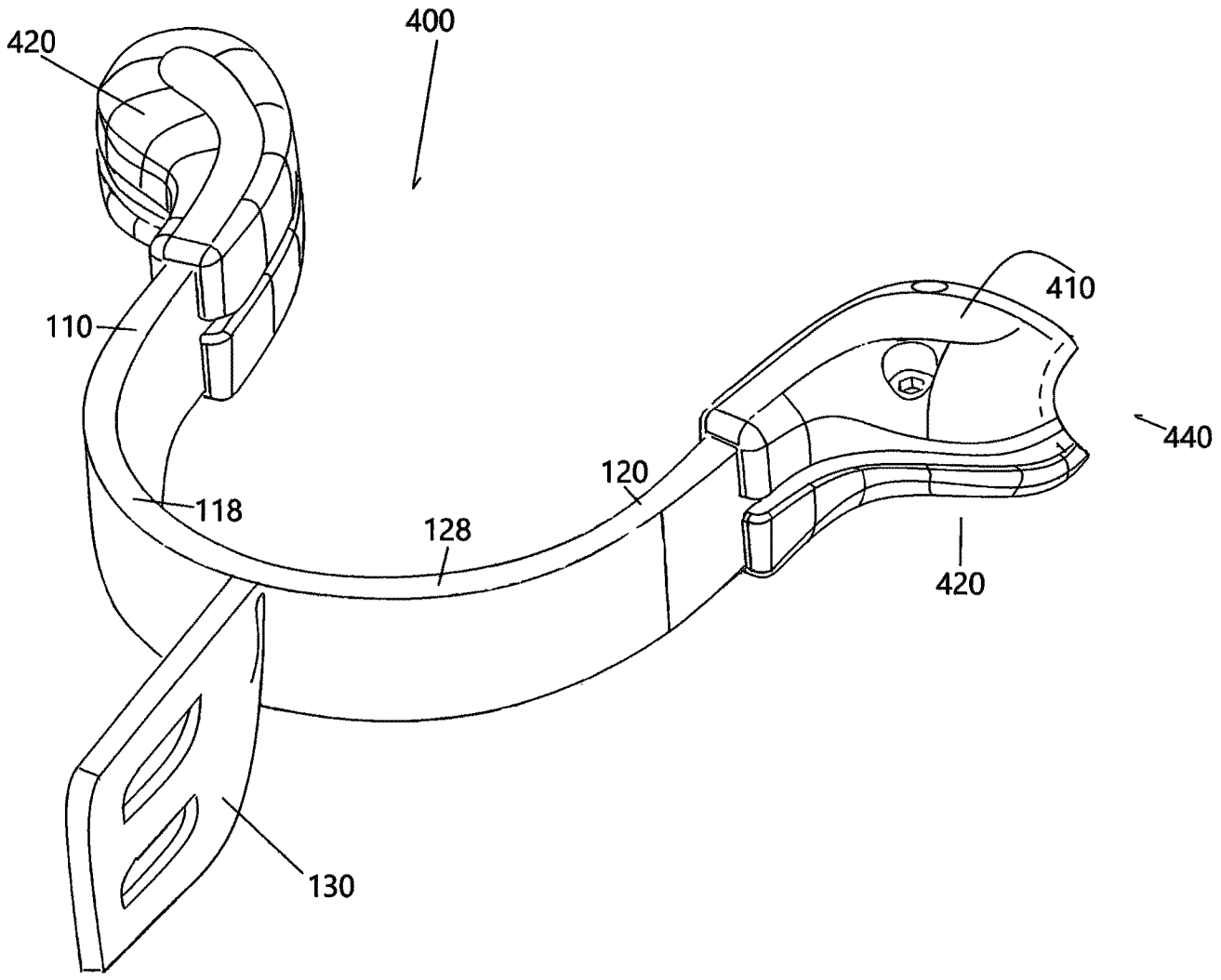
FIG. 23 shows the assembled sleeves on the oar, fork or U-shape gate latch, with the rubber insert bumper attached to one end.

FIG. 21 is a top view of the rubber insert bumper 440 for use with the concave openings 416, 426 on the assembled sleeves 410, 420 on the flange arms 110, 120 of the oar, fork or U-shape gate latch, of FIG. 20. FIG. 22 is a partial rear end view of one of the assembled sleeves 410, 420 on one end of the oar, fork or U-shape gate latch of the preceding figures with the rubber insert bumper 440 ready to be attached thereon. FIG. 23 shows the assembled sleeves on the oar, fork or U-shape gate latch, with the rubber insert bumper 440 attached to one end of the assembled half sleeves 410, 420.

Referring to FIGS. 18-23, the stems 444 with outer expanding sides of the rubber type bumpers 440 are inserted into the concave openings 419, 429 in the ends of the assembled sleeves 410, 420, so that the rounded cap head 442 covers the concave tip ends 416, 426 of the assembled half sleeves 410, 420. Although rubber is described, the bumpers can include other materials, such as but not limited to foam, and the like.

Although the embodiment shows a pair of fasteners, 432, 434 being used to attach the first half sleeve 410, to the second half sleeve 420, the invention can be used with one fastener to attach the half sleeves 410, 420 together.

While the fasteners 432, 434 are described as being screws with threaded shafts, other types of fasteners, can be used such as but not limited to self tapping friction locking fasteners, and the like.

Although the heads on the fasteners 432, 434 are shown with indented hex heads, such as those used in restrooms and the like, the heads can be raised hex heads and the like.

The two part sleeves and be packaged as kits for to be used with an oar, fork or U-shape gate latch. The enlarged curved channels 415, 425 in the half sleeves 410, 420 can be large enough to fit over different sized right and left flange arms 110, 120 in different oar, fork or U-shape gate latches.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. Two part sleeve covers for protecting ends of existing arms of a pivotable U-shaped gate latch, comprising:

a first half sleeve having a generally curved shape with a stem end having an opening and an opposite end, the first half sleeve having sides which expand outward from the stem end to a convex rounded mid portion and which taper inward to the opposite end, the first half sleeve having a curved channel running from the opening in the stem end and ending before the opposite end;

a second first half sleeve having a generally curved shape with a stem end having an opening and an opposite end, the second half sleeve having sides which expand outward from the stem end to a convex rounded mid portion and which taper inward to the opposite end, the second half sleeve having a curved channel running from the opening in the stem end and ending before the opposite end;

fasteners for attaching the first half sleeve to the second half sleeve, wherein the first half sleeve and the second half sleeve are each fastened about each of the existing arms of the pivotable U-shaped gate latch in order to protect the ends of the existing arms of the pivotable U-shaped gate latch; and a pliable bumper about an outer end portion of an assembled combination of the first half sleeve and the second half sleeve.

2. The two part sleeve covers of claim 1, wherein the fasteners include screws.

3. The two part sleeve covers of claim 1, wherein the fasteners include pins.

4. The two part sleeve covers of claim 1, further comprising:

caulking or bonding or adhering or filling materials located in the channels of the first half sleeve and the second half sleeve to enhance locking of the half sleeves to the existing arms.

5. The two part sleeve covers of claim 1, wherein the pliable bumper includes:

a rubber bumper.

6. The two part sleeve covers of claim 1, wherein the pliable bumper includes a curved outer cap head.

7. The two part sleeve covers of claim 1, wherein the first half sleeve and the second half sleeve, each include:

concave openings, and for receiving stem portions of each pliable bumper.

8. A method of protecting ends of existing arms of a pivotable U-shaped gate latch, comprising:

providing a pair of first half sleeves, each having a curved channel running from an opening in a stem end and ending before an opposite end;

positioning one of the first half sleeves about an upper edge of one of the arms on the U-shaped gate latch;

providing a pair of second first half sleeves, each having a curved channel running from the opening in the stem end and ending before the opposite end;

positioning one the second half sleeves about a lower edge of the one of the arms on the U-shaped gate latch;

attaching the one of the first half sleeves to the one of the second halve sleeves on the one of the arms on the U-shape gate latch with a fastener;

positioning another of the first half sleeves about an upper edge of another of the arms on the U-shaped gate latch;

positioning another of the second half sleeves about a lower edge of another of the arms on the U-shaped gate latch;

attaching the another of the first half sleeves to the another of the second halve sleeves on the another of the arms on the U-shape gate latch with another fastener; and attaching bumpers to outer end portions of assembled pairs of the first half sleeves and the second half sleeves.

9. The method of claim 8, wherein the attaching steps include:

fastening each of the first half sleeves to the second half sleeves with screws.

10. The method of claim 8, wherein the attaching steps include:

fastening each of the first half sleeves to the second half sleeves with pins.

11. The method of claim 8, further comprising the steps of:

caulking or bonding or adhering or filling materials located in the channels of the first half sleeve and the second half sleeve to enhance locking of the half sleeves to the existing arms.

12. The method of claim 8, further comprising the steps of:

inserting stem portions of the bumpers into openings in the outer end portions of the assembled pairs of the first half sleeves and the second half sleeves.

13. A cover sleeve assembly for protecting arm ends of a pivotable U-shaped gate latch, comprising:

a first pair of half sleeves, each having a generally curved shape with a curved channel running from an opening in a stem end to a rear end;

a first fastener for attaching the first pair of half sleeves about a first existing arm of the pivotable U-shaped gate latch in order to protect an exposed first arm end of the pivotable U-shaped gate latch;

a first pliable bumper extending outward from the opening in each of the first pair of attached half sleeves;

a second pair of half sleeves, each having a generally curved shape with a curved channel running from an opening in a stem end to a rear end;

a second fastener for attaching the second pair of half sleeves about a second existing arm of the pivotable U-shaped gate latch in order to protect an exposed second arm end of the pivotable U-shaped gate latch; and a second pliable bumper extending outward from the opening in each of the second pair of attached half sleeves.

14. The cover sleeve assembly of claim 13, wherein both the first fastener and the second fastener, each comprise:

a pair of fasteners.

15. The cover sleeve assembly of claim 13, wherein the first fastener and the second fastener include: screws.

16. The cover sleeve assembly of claim 13, wherein the first fastener and the second fastener include: pins.

17. The cover sleeve assembly of claim 13, further comprising:

caulking or bonding or adhering or filling materials located in the channels of the sleeves to enhance locking to the existing arms.

* * * * *